US006457527B2

(12) United States Patent
Wells

(10) Patent No.: US 6,457,527 B2
(45) **Date of Patent: *Oct. 1, 2002**

(54) APPARATUS AND METHOD FOR ADDING BUOYANCY TO RISER WITH INFLATABLE FLOATATION COLLAR

(76) Inventor: Granville Louis Wells, c/o Hazel Wells, 3219 Burke Rd., Apt 314, Pasadena, TX (US) 77504

( * ) Notice: Subject to any disclaimer, the term of this patent is extended or adjusted under 35 U.S.C. 154(b) by 0 days.

This patent is subject to a terminal disclaimer.

(21) Appl. No.: 09/874,345

(22) Filed: Jun. 5, 2001

Related U.S. Application Data

(62) Division of application No. 09/042,906, filed on Mar. 17, 1998, now Pat. No. 6,257,337.

(51) Int. Cl.[7] ..... E21B 33/037

(52) U.S. Cl. ..... 166/350; 166/367; 405/195.1; 405/162; 405/211; 405/224.2; 441/30; 114/243

(58) Field of Search ..... 166/350, 367; 405/195.1, 211, 171, 216, 158, 162, 224, 224.1, 224.4; 441/9, 30; 114/243, 264; 175/5, 7, 8

(56) References Cited

U.S. PATENT DOCUMENTS

| | | | | | |
|---|---|---|---|---|---|
| 2,395,892 | A | * | 3/1946 | Lontz | 441/133 |
| 3,090,976 | A | * | 5/1963 | Liu | 441/29 |
| 3,594,835 | A | * | 7/1971 | Wilson | 405/171 X |
| 3,602,300 | A | * | 8/1971 | Jaffe | 166/351 |
| 3,633,369 | A | * | 1/1972 | Lawrence | 405/205 |
| 3,729,756 | A | * | 5/1973 | Cook et al. | 441/133 |
| 3,765,185 | A | * | 10/1973 | Peck et al. | 405/168.1 |
| 3,855,656 | A | * | 12/1974 | Blenkarn | 166/350 X |
| 3,955,621 | A | * | 5/1976 | Webb | 175/7 X |
| 4,037,425 | A | * | 7/1977 | Berg | 405/200 |
| 4,098,333 | A | * | 7/1978 | Wells et al. | 175/7 X |
| 4,176,986 | A | * | 12/1979 | Taft et al. | 166/350 X |
| 4,234,047 | A | * | 11/1980 | Mott | 166/350 |
| 4,477,207 | A | * | 10/1984 | Johnson | 405/195.1 |
| 4,566,824 | A | * | 1/1986 | Minier et al. | 175/7 X |
| 4,643,614 | A | * | 2/1987 | Laursen | 166/350 |
| 5,044,450 | A | * | 9/1991 | Aso et al. | 175/7 |
| 5,046,896 | A | * | 9/1991 | Cole | 405/195.1 |
| 5,330,294 | A | * | 7/1994 | Guesnon | 405/224.2 |
| 6,257,337 | B1 | * | 7/2001 | Wells | 166/350 |

FOREIGN PATENT DOCUMENTS

| | | | |
|---|---|---|---|
| DE | 2841819 | * | 4/1980 |

* cited by examiner

*Primary Examiner*—Heather Shackelford
*Assistant Examiner*—Jong-Suk Lee
(74) *Attorney, Agent, or Firm*—John R Casperson

(57) ABSTRACT

A drilling unit comprises a floating drilling rig, a subsea wellhead, and a riser connecting the subsea drilling rig with the subsea wellhead. A floatation collar encircles the riser so as to reduce deck load on the floating drilling rig. The floatation collar comprises a hollow fabric body filled with gas. The floatation collar has a longitudinal axia and is formed from a sidewall body having a longitudinally extending slit extending through the sidewall body. The slit enables the floatation collar to be transversely mounted onto the marine riser.

5 Claims, 3 Drawing Sheets

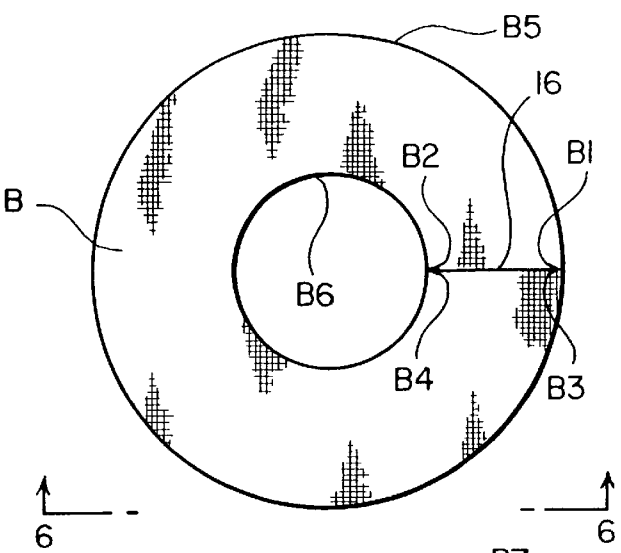
FIG. 5
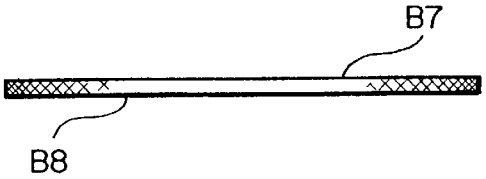
FIG. 6
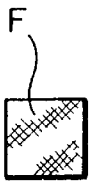
FIG. 10
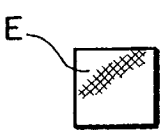
FIG. 9
FIG. 3
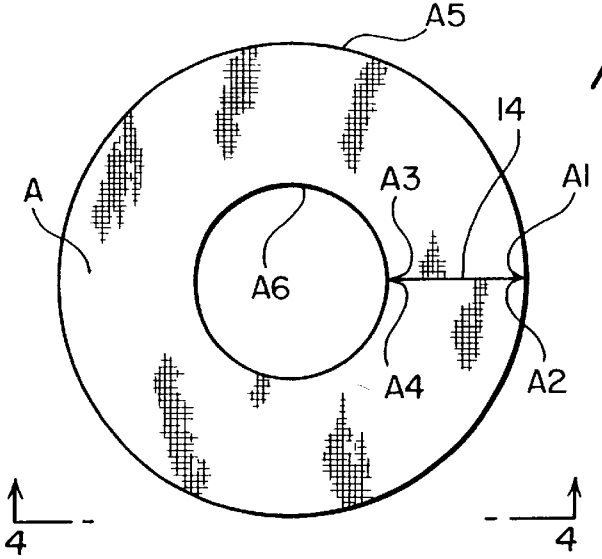
FIG. 4
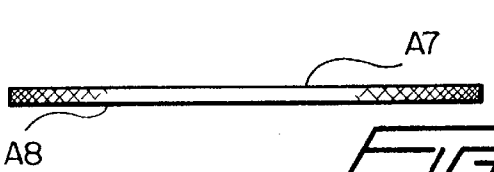
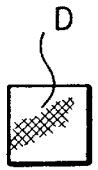
FIG. 8
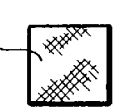
FIG. 7

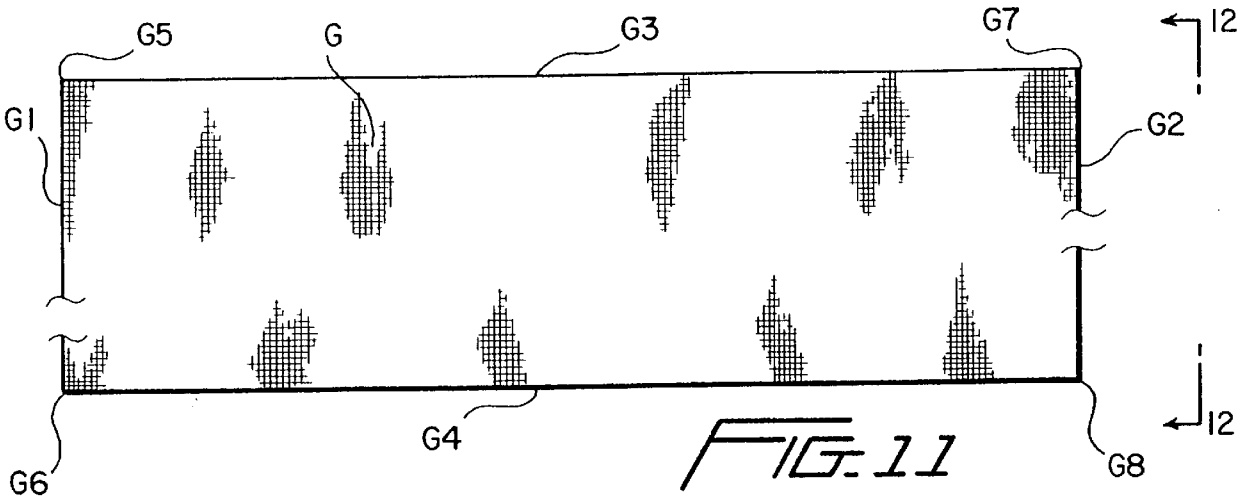
FIG. 11
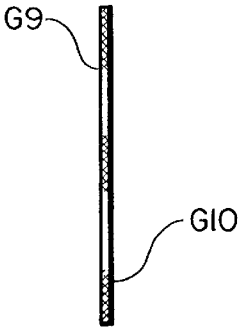
FIG. 12
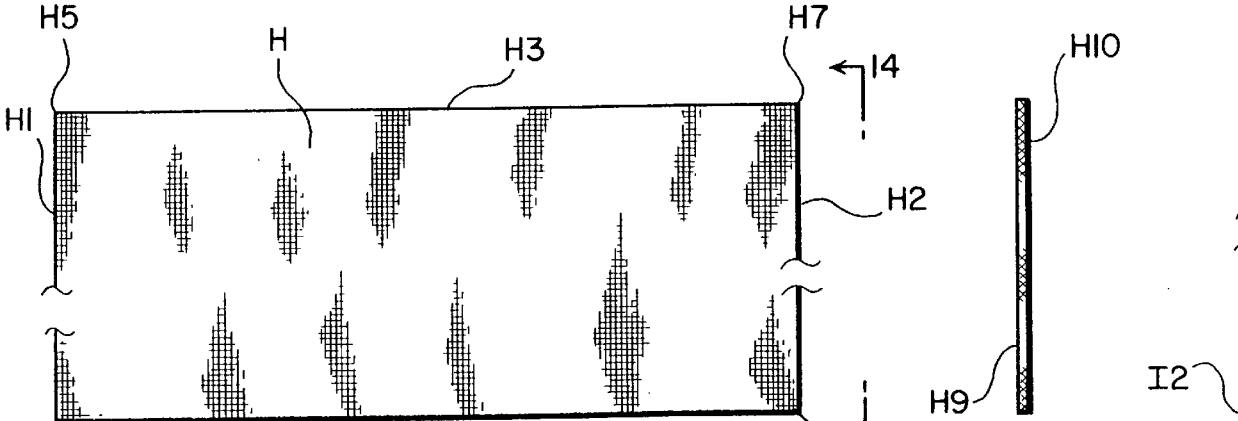
FIG. 13
FIG. 14
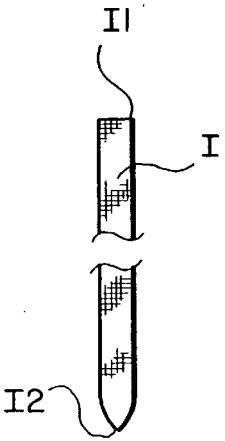
FIG. 15
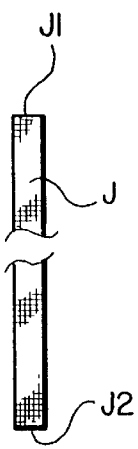
FIG. 16

APPARATUS AND METHOD FOR ADDING BUOYANCY TO RISER WITH INFLATABLE FLOATATION COLLAR

CROSS REFERENCES TO RELATED APPLICATIONS

This application is a division of application Ser. No. 09/042,906 filed Mar. 17, 1998, now 6,257,337

BACKGROUND OF THE INVENTION

Floating drilling rigs often need riser floatation to maintain safe working conditions. By buoying up the riser, the deck load on the rig can be reduced, and a low center of gravity can be maintained. For this reason, a number of riser floatation devices or riser tensioners, have been proposed. However, those in commercial use have a number of drawbacks.

Slipping conventional riser tensioners is dangerous business, extremely dangerous when on a moving rig in rough weather.

Further, conventional riser tensioners consume large quantities of wire rope, and for that reason have a high operating cost in addition to the high costs of fluid and repair parts used to keep them operational.

Also, conventional riser floatation is expensive, and is bulky to ship. Periodic removal, inspection and reinstallation of conventional floatation is a labor intensive and expensive operation.

OBJECTS OF THE INVENTION

It is an object of this invention to provide a floatation device for a marine riser that reduces top tension in the riser.

It is another object of this invention to provide a floatation device for a marine riser that reduces deck load on a drilling platform above the riser.

It is a further object of this invention to provide a floatation device for a marine riser that results in an increase in the life of wire rope life which is used in the drilling operations.

It is another object of this invention to provide a floatation device for a marine riser that enables drilling rigs to operate at greater depths than before.

It is another object of this invention to provide a floatation device for a marine riser that is inexpensive as compared to floatation devices currently in commercial use, and which is lighter and more compact to store and ship.

It is another object of this invention to provide a floatation device for a marine riser which has lower maintenance requirements than currently used floatation devices, and which is easier to inspect and replace.

It is another object of this invention to provide a riser floatation device for which a rig can be upgraded without shipyard modification.

SUMMARY OF THE INVENTION

In one embodiment of the invention, there is provided a band-shaped floatation collar for a marine riser. The floatation collar has a longitudinal axis and is formed from a sidewall body having a longitudinally extending slit extending through the sidewall body. The slit enables the floatation collar to be transversely mounted onto the marine riser. The mounting can easily be accomplished without substantial modification of the drilling rig, such as in the moon pool area.

In another embodiment of the invention, there is provided a floatation collar for a drilling riser. The floatation collar has an upper end and a lower end and a longitudinal axis extending from the upper end to the lower end. A first generally cylindrical sidewall surface defines an inside periphery for the flotation collar and is coaxial with the longitudinal axis. A second generally cylindrical sidewall surface defines an outside periphery for the floatation collar and is positioned radially outwardly from the first generally cylindrical sidewall surface and is additionally coaxial with the longitudinal axis. An arcuate upper end closure surface joins the first generally cylindrical sidewall surface with the second generally cylindrical sidewall at the upper end of the collar. An arcuate lower end closure surface joins the first generally cylindrical sidewall surface with the second generally cylindrical sidewall surface at the lower end of the floatation collar. A first generally rectangular panel surface joins the first generally cylindrical sidewall surface, the second generally cylindrical sidewall surface, the arcuate upper end closure surface, and the arcuate lower end closure surface and is positioned in a plane extending near radially from the longitudinal axis. A second generally rectangular panel surface joins the first generally cylindrical sidewall surface, the second generally cylindrical sidewall surface, the arcuate upper end closure surface, and the arcuate lower end closure surface and is positioned closely alongside the first generally cylindrical panel surface. A slit is formed between the first generally rectangular panel surface and the second generally rectangular panel surface.

The collar is preferably formed by a plurality of wall members defining the various surfaces which enables it to be inflated to provide the necessary buoyancy. Using gas to provide the buoyant force is inexpensive and highly efficient. The device can be smaller than foam filled or metal walled buoys of the same lift, lessening drag by ocean currents. By using fabric wall members, the device can be easily shipped, stored, and deployed. The slit facilitates mounting the device on a riser.

In another embodiment of the invention, there is provided a drilling unit comprising a floating drilling rig, a subsea wellhead, and a riser connecting the subsea drilling rig with the subsea wellhead. A floatation collar encircles the riser so as to reduce deck load on the floating drilling rig. The floatation collar comprises a hollow fabric body filled with gas.

In yet another embodiment of the invention, there is provided a method for adding buoyancy to a riser extending beneath a marine drilling rig and into the water. The method is carried out by lowering a first riser section to beneath the drilling rig main deck. A gripping collar is attached to the first riser section. A plurality of straps are attached to the gripping collar. A second riser section is attached to an upper end of the first riser section. The second riser section is lower to beneath the drilling rig main deck. An inflatable collar is positioned around the second riser section. The inflatable collar is attached to the gripping collar via the plurality of straps. The inflatable collar, is inflated and the second riser section carrying the inflatable collar is submerged to provide the buoyancy.

The amount of buoyance is easily adjusted depending on need by varying the number and/or size of the collars employed. As the working depth of the collars increases, the gas pressure required to provide a given amount of lift will increase. However, the pressure difference across the sidewall of the float will remain at low levels, enabling the device to be constructed inexpensively of fabric.

BRIEF DESCRIPTION OF THE DRAWINGS

FIG. 3 is a top plan view of a portion of the cell shown in FIG. 2.

FIG. 4 is a side view of the cell portion shown in FIG. 3 when viewed along lines 4—4.

FIG. 5 is a bottom plan view of a portion of the cell shown in FIG. 2.

FIG. 6 is a side view of the cell portion shown in FIG. 5 when viewed along lines 6—6.

FIGS. 7–10 are plan views of additional cell portions employed in a preferred embodiment of the invention.

FIG. 11 is a plan view of a portion of the cell shown in FIG. 2 prior to assembly.

FIG. 12 is a side view of the cell portion shown in FIG. 11 when view along lines 12—12.

FIG. 13 is a plan view of another portion of the cell shown in FIG. 2 prior to assembly.

FIG. 14 is a side view of the cell portion shown in FIG. 13 when view along lines 14—14.

FIG. 15 is a plan view a another portion of the cell shown in FIG. 2 prior to assembly.

FIG. 16 is a plan view of another portion of the cell shown in FIG. 2 prior to assembly.

DETAILED DESCRIPTION OF THE INVENTION

Figure 2:
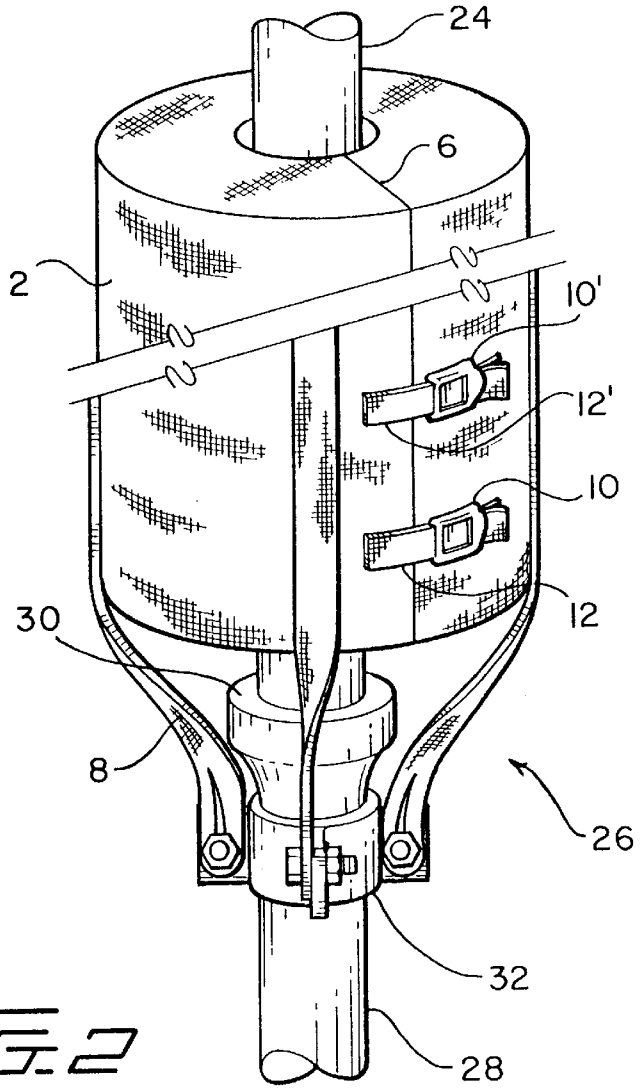
FIG. 2 is a pictorial representation of a single flotation cell schematically shown in FIG. 1.

With reference to FIG. 2, there is s provided a band-shaped floatation collar 2 for a marine riser 4. The floatation collar has a longitudinal axis and is formed from a sidewall body having a longitudinally extending slit 6 extending through the sidewall body. The slit enables the floatation collar to be transversely mounted onto the marine riser, and generally speaking, leads from a generally cylindrical outside surface to a generally cylindrical inside surface of the collar body.

The collar 2 has an upper end and a lower end. A plurality of straps 8 extend from the lower end of the collar for securing the collar to the riser.

The collar surfaces are preferably formed by a plurality of gas impermeable walls such as walls A, B, G and H shown in FIGS. 3–6 and 11–14. The plurality of gas impermeable walls preferably define a closed chamber. Suitable fittings and valves preferably extend through one or more of the walls to provide for pressurization and depressurization of the chamber by gas. These fittings and valves can be mounted to fabric pieces C, D, E and F shown in FIGS. 7–10, for example, and mounted on the top or bottom wall structures.

A plurality of first fastener halves 10, 10' are mounted to the outside generally cylindrical surface on one side of the slit and a plurality of second fastener halves 12, 12' are mounted to the outside generally cylindrical surface on the other side of the slit to provide for fastening the floatation collar 2 circumferentially around the marine riser 4.

The preferred collar is formed by a plurality of wall members which enable it to be inflated to provide the necessary buoyancy and is illustrated, prior to assembly, by FIGS. 3–16. A first generally cylindrical sidewall (H, FIG. 13) defines an inside periphery for the flotation collar and is coaxial with the longitudinal axis of the collar. A second generally cylindrical sidewall (G, FIG. 11) defines an outside periphery for the floatation collar and is positioned radially outwardly from the first generally cylindrical sidewall and is additionally coaxial with the longitudinal axis of the collar. An arcuate upper end closure (A, FIG. 3) joins the first generally cylindrical sidewall with the second generally cylindrical sidewall at the upper end of the collar. An arcuate lower end closure (B, FIG. 5) joins the first generally cylindrical sidewall with the second generally cylindrical sidewall at the lower end of the floatation collar. A first generally rectangular panel portion joins the first generally cylindrical sidewall, the second generally cylindrical sidewall, the arcuate upper end closure, and the arcuate lower end closure and is positioned in a plane extending near radially from the longitudinal axis (first end portion of G, FIG. 11, extending along segment A1–A3, FIG. 3, and B3–B4, FIG. 5). A second generally rectangular panel portion joining the first generally cylindrical sidewall, the second generally cylindrical sidewall, the arcuate upper end closure, and the arcuate lower end closure and is positioned closely alongside the first generally cylindrical panel member (second end portion of G, FIG. 11, extending along segment A2–A4, FIG. 3, and B1–B2, FIG. 5). The slit 6 (See FIG. 2) is formed between the first generally rectangular panel portion and the second generally rectangular panel portion.

The arcuate upper end closure A is generally annularly shaped and has a generally circular inner periphery A6 and a generally circular outer periphery AS. A split 14 extends generally radially from the outer periphery to the inner periphery and is defined by a first generally radially extending edge surface A1–A3 and a second generally radially extending edge surface A2–A4. The arcuate lower end closure is generally annularly shaped and has a generally circular inner periphery B6 and a generally circular outer periphery B5. A split 16 extends generally radially from the outer periphery to the inner periphery defined by a first generally radially extending edge surface (B3–B4) and a second generally radially extending edge surface (B2–B1). The arcuate upper end closure and the arcuate lower end closure are substantially identically shaped and, once assembled, are positioned in generally parallel planes.

A plurality of outer straps I having a first end and a second end attached by their first end to the second generally cylindrical sidewall which defines the outside periphery for the floatation collar and extend beyond the lower end of the floatation collar. Preferably, a plurality of inner straps I having a first end and a second end are attached by their first end to the first generally cylindrical sidewall which defines the inside periphery for the floatation collar and extend beyond the lower end of the floatation collar. The inner straps can be attached as described in the example. FIG. 2 illustrates outer straps attached to the cylindrical sidewall.

The cells could be made of one piece. Strips could be added to quarter the cells internally, leaving them open at the bottom to allow redundancy, if desired.

The cells can be constructed from urethane coated polyester woven type or a urethane coated nylon woven type. Preferred materials of this type are available from Cooley Industries. The pieces can be attached by welding or sewing. Most preferably, aramid fabric such as KEVLAR fabric is used. The fabric can be coated as necessary to prevent water or air infiltration. For certain applications, the cells could be constructed of foam or metal sidewalls. However, such cells would be more difficult to store and have less lift than the preferred embodiment of the invention, and may need additional hardware for proper operability, such as a hinge opposite the slit.

Figure 1:
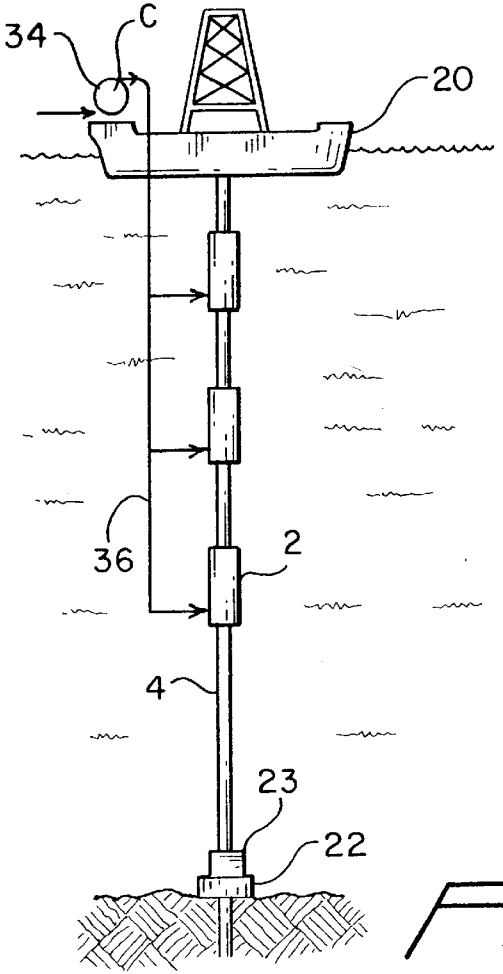
FIG. 1 schematically illustrates use of one embodiment of the invention employing a plurality of floatation cells.

Referring to FIG. 1, there is shown a drilling unit comprising a floating drilling rig 20, a subsea wellhead 22, and a riser 4 connecting the drilling rig with the subsea wellhead. A floatation collar 2 encircles the riser so as to reduce deck load on the floating drilling rig. The floatation collar comprises a hollow fabric body filled with gas, and can be as described hereinabove. A blow out preventer (BOP) 23 is generally also present on the wellhead and the riser connects to the BOP.

As is known in the art, the riser is generally formed from a plurality of pipe joints connected in end to end relationship. As shown in FIG. 2, it is preferred that the floatation collar surrounds a first pipe joint 24. A means 26 for attaching the floatation collar to a second pipe joint 28 positioned beneath the first pipe joint is preferably employed so as to reduce deck load on the floating drilling rig.

By attaching the float to a riser joint beneath the riser joint on which it is positioned, it is impossible for the float to be longitudinally displaced on the riser, due to the presence of joint connection 30. The means 26 preferably comprises a metal collar 32 extending circumferentially around the second pipe joint 28 and fixedly attached thereto, and a plurality of straps 8 each having a first end and a second end and attached by its first end to the metal collar and by its second end to the floatation collar.

In use, the floatation collar will generally be employed in combination with a gas compressor 34 positioned on the floating drilling rig 20 and a fluid flow line 36 extending from the gas compressor to the floatation collar to provide buoyant gas to the floatation collar.

The invention can be employed to carry out a method for adding buoyancy to a riser extending beneath a marine drilling rig and into the water. The method is carried out by lowering a first riser section to beneath the drilling rig main deck, such as to the moon pool area. A gripping collar is attached to the first riser section. A plurality of straps are attached to the gripping collar. A second riser section is attached to an upper end of the first riser section. The second riser section is lowered to beneath the drilling rig main deck. An inflatable collar is positioned around the second riser section. The inflatable collar is attached to the gripping collar via the plurality of straps. The inflatable collar is inflated and the second riser section carrying the inflatable collar is submerged to provide the buoyancy.

The collar is preferably provided with a split so that it can be transversely installed on the riser in the moon pool area. This is carried out by opening the inflatable collar to expose a pocket for receiving the second riser section, receiving the second riser section in the pocket of the inflatable collar; and closing the inflatable collar to retain the inflatable collar in position on the second riser section. The float is preferably deployed by attachment of a gas line to the inflatable collar and supplying gas to the inflatable collar after submerging via the gas line.

EXAMPLE

Making the Submerged Riser Tensioner (SRT)

General

Refer to FIGS. 3–16.

Outside diameter is dictated by the size of piece A (top end wall). Overall length is dictated by the length of piece G (outside sidewall), edge G1 (vertical). The width of piece G is dictated by the dimensions of piece A, overall length of the circumference of edge A5 plus the distance from corner A1 to corner A2 plus the distance between corner A3 and corner A4.

Piece B (bottom end wall) size is dictated by piece A, of which piece B is a mirror image. Piece H (inside sidewall) size (width) is dictated by the diameter of the inside circumference A6 of piece A1, and overall length by piece G edge G1. The straps, piece I and piece J are attached to pieces G and H respectively, prior to the attachment of all the combined pieces, as are the pieces C and D, onto piece A, and pieces E and F onto piece B. Pieces C, D, E, F are composed merely of a square patch 12" by 12" patch made in a suitable fashion and incorporating a pipe sized female fitting attached to the top, piece A and the bottom, piece B for the use of inflation and use of control ports for the medium of compressed gas which is to be used to inflate the cell . . . (air, nitrogen, helium . . . etc.)

Installing the Vertical Straps onto the Inner Cylinder

Beginning 6 inches away from corner H5, attach piece I parallel to H1 until reaching H6. Upon reaching H6 with piece I cut I2 40 inches past H6 and attach I2 back on top of 1. Attach I2 on I to form an eye 2 inches in diameter in the end of piece I. Attach similar pieces of I onto H10, all parallel to H1, spaced equally apart 12 inches, until reaching a point as measured from 3 inches before reaching H2.

Installing Vertical Straps on Outer Cylinder

Attach piece I to piece G10 placing the first of a plurality of pieces "I", beginning the distance as dictated from A1 to A3, away from the edge of piece G side G1 in a direction towards G2. Measure the distance from G1 to G2 and attach I onto G3 side G10. Attach I onto G10 parallel to G1. Upon reaching the edge of G4 with I2 cut an additional 40" to the overall length of I beyond the intersection of I2 and G3, Attach I2 back on the surface of I to form a 2 inch attachment eye in the end. Repeat attachment of subsequent copies spaced equally at 12" intervals across the surface of G10, all parallel to G1 until reaching the point before reaching edge G2 as previously measured for the first I piece that was attached.

Installing Horizontal Straps on Outer Cylinder

Beginning a distance of 8 inches from J1 on piece J, attach J1 to G10, Attachment beginning the same distance as measured from A1 to A3 on piece A, attach J1 from edge G1 side G10. Attach J to G10 beginning 3' down from edge G3 towards edge G4 but parallel to edge G3 until reaching a point as measured back from edge G4 as measured from A1 to A3 plus 2 inches. After attachment of J place J2 on to of J to form an eye 2 inches in diameter and attach J2 to J. Attach the end J1 back on top of J and repeat as done for end J2. Continue attachment of identical pieces, all placed parallel to edge G3, 12" apart until reaching a place 3 inches before edge G4.

Installing Pipe Fittings Top and Bottom

At a place along the same radius at the radius of side A6, attach piece C onto side A7 equally spaced from edge A5 and A6 to be the place of the placement radius, one half the distance as measured from between corner A1 and corner A3. At a place along the same radius place and attach piece D two feet from the placement of piece C.

Do the same on Piece B, attaching pieces E and F.

Attaching Inside Cylinder Wall to Top End Wall

Beginning with corner H5 side H9, attach H5 to A corner A3. Attach edge H3 onto edge A6 side A7, finishing when attachment of A4 to H7 concludes.

Attaching Outside Cylinder Wall to Top End Wall

Continuing with corner G5 of piece G, side G9, attach G5 to part A, side A7, starting at corner A3. Attach edge G3 of piece G to piece A, along the line connecting A3 to A1, reaching corner A1, continue attachment of edge G3 to piece G, side G9, to edge A5, continuing attachment to edge G3 along the line connecting A2 and A4 concluding with the attachment of corner G7 and corner A4.

Attaching Inside and Outside Cylinder Walls to Form Slit

Continuing at corner H5, Part H, side H9, attach H5 to G5, side G9. Continue attachment of edges G1 of part G side G9 to edge of part H side H9 edge H1, continuing with the attachment of corners G6 and H6. Proceed attachment of corners G7 to H7, attach edge G2 with edge H2, ending with the attachment of corner G8 and corner H8.

Attaching Inside Cylinder Wall to Bottom End Wall

Continuing with piece B, side B8, with side B8 facing opposite side A7, attach corner B2 to corner H6 side H10. Continue attachment of edge H4 to edge B6, ending with the attachment of corners H8 and B4.

Attaching Outside Cylinder Wall to Bottom End Wall

Concluding with corner B4 of piece B, side B8, attach B4 to corner H8, side H10 of piece H. Attach edge B6 to edge H4, until reaching the attachment of corners B2 and H6. Attach corners G6 and B4 and attach G4 along the edge connecting B4 with B3. Attach edge G4 with edge B5 ending by attaching B1 and G4. Attach edge G4 to the edge between corners B2 and B1 concluding and ending by attaching G4 at corner B11.

CALCULATED EXAMPLE

A drilling rig is equipped with a BOP that weighs 240,000 pounds. The LMRP weighs 120,000 pounds. Operation in 2500 feet of water will require fifty 50-foot joints of riser that weigh 9370 pounds each, which, without floatation, will weigh 468,000 pounds.

Floatation in accordance with the invention can be provided with a 1 hp 20 cfm compressor, 1 hose reel, 1 check valve, 1 valve, 4 BOP Buoy bags 10'×12' or 942 cubic feet each, 4 LMRP bags of 752 cubic feet each, 1 hose reel and 2500 feet of hose, use of some pod function or the ROV, and four 8×50 foot SRTs, each of which will provide about 160,000 pounds of lift.

While certain preferred embodiments of the invention have been described herein, the invention is not be to construed as being so limited, except to the extent that such limitations are found in the claims.

What is claimed is:

1. An apparatus comprising a floating drilling rig;

a subsea wellhead;

a riser connecting the floating drilling rig with the subsea wellhead; and a floatation collar encircling the riser so as to reduce deck load on the floating drilling rig, wherein the floatation collar comprises a hollow fabric body filled with gas, wherein the riser is formed from plurality of pipe joints connected in end relationship, and the floatation collar surrounds a first pipe joint, wherein said apparatus further comprises a metal collar extending circumferentially around a second pipe joint positioned beneath the first pipe joint and fixedly attached thereto; and a plurality of straps each having a first end and a second end and attached by its first end to the metal collar and by its second end to the floatation collar, wherein the floatation collar is band-shaped and is formed from a sidewall body having a longitudinally extending slit extending through the sidewall body to enable the floatation collar to be transversely mounted onto the riser.

2. The apparatus as in claim 1 further comprising a gas compressor positioned on the floating drilling rig;

a fluid flow line extending from the gas compressor to the floatation collar to provide buoyant gas to the floatation collar.

3. The apparatus as in claim 1 wherein the plurality of straps join the sidewall body across the slit to retain the floatation collar in position on the riser.

4. A method for adding buoyancy to a riser extending beneath a marine drilling rig and into the water, said method comprising providing an inflatable collar having a plurality of straps attached thereto, lowering a first riser section to beneath a main deck of the drilling rig, attaching a gripping collar to said first riser section, attaching the plurality of straps to the gripping collar, attaching a second riser section to an upper end of the first riser section, lowering the second riser section to beneath the drilling rig main deck;

attaching the inflatable collar around the second riser section, wherein the inflatable collar is attached to the gripping collar via the plurality of straps;

inflating the inflatable collar, and submerging the second riser section carrying the inflatable collar;

wherein the step of attaching the inflatable collar comprises the steps of opening the inflatable collar to expose a pocket for receiving the second riser section;

receiving the second riser section in the pocket of the inflatable collar; and closing the inflatable collar to retain inflatable collar in position on the second riser section.

5. The method as in claim 4 further comprising attaching a gas line to the inflatable collar; and supplying gas to the inflatable collar after submerging the inflatable collar.

* * * * *